US005238411A

United States Patent [19]

Jinno et al.

[11] Patent Number: 5,238,411

[45] Date of Patent: Aug. 24, 1993

[54] CONNECTOR FOR PRINTED CIRCUIT BOARD

[75] Inventors: Keishi Jinno; Tamio Watanabe; Sakai Yagi; Takayoshi Endo, all of Shizuoka, Japan

[73] Assignee: Yazaki Corporation, Tokyo, Japan

[21] Appl. No.: 858,850

[22] Filed: Mar. 27, 1992

[30] Foreign Application Priority Data

Mar. 28, 1991 [JP] Japan ..... 3-019372[U]

[51] Int. Cl.[5] ..... H01R 9/09; H01R 13/40

[52] U.S. Cl. ..... 439/59; 439/76; 439/595; 439/636; 439/637

[58] Field of Search ..... 439/59, 76, 79, 80–82, 439/247, 593, 595, 597, 603, 630, 632, 636, 637, 867, 871–873

[56] References Cited

U.S. PATENT DOCUMENTS 3,808,589 4/1974 Bonhomme ..... 439/637
4,367,006 1/1983 Rehbogen, Jr. et al. ..... 439/636
4,750,893 6/1988 Sueyaoshi et al. ..... 439/596
4,969,840 11/1990 Ii et al. ..... 439/77
5,044,972 9/1991 Ikeda ..... 439/595

*Primary Examiner*—Paula A. Bradley
*Attorney, Agent, or Firm*—Sughrue, Mion, Zinn, Macpeak & Seas

[57] ABSTRACT

In a connector A for a printed circuit board, the printed circuit board 3 is adapted to be held between and connected to a resilient contact piece 5 of each connection terminal 1, received in a terminal receiving chamber 13 of a connector housing 2, and a top plate portion 8 of the connection terminal 1 disposed in opposed relation to the resilient contact piece 5. A guide projection 16 to which the top plate portion 8 is adapted to be fitted is formed on an end wall 14*a* of the terminal receiving chamber 13 of the connector housing 2. The deformation of connection terminals attached to a connector housing can be prevented, thereby enabling a smooth, positive connection of the printed circuit board.

8 Claims, 4 Drawing Sheets

CONNECTOR FOR PRINTED CIRCUIT BOARD

BACKGROUND OF THE INVENTION

This invention relates to a connector for a printed circuit board which prevents the deformation of connection terminals attached to a connector housing, thereby achieving a positive connection of the printed circuit board.

FIG. 6 is an exploded perspective view of a connector B for a printed circuit board described in Japanese Laid-Open Utility Model Application No. 53-163585.

In this Figure, reference numeral 20 denotes a male connector, reference numeral 21 a female connector, and reference numeral 22 a printed circuit board. A male connector housing 23 receives connection terminals 25 each having a resilient contact piece 24, and a female connector housing 26 receives connection terminals 30 each of which has at one end portion a contact tab 27 for engaging the resilient contact piece 24, and also has at the other end portion a connection portion 29 for connected to a circuit end portion 28 of the printed circuit board 22.

As shown in FIG. 7, the connection portion 29 of the connection terminal 30 has a resilient contact piece 32 formed integrally with a base plate portion 31, and a top plate portion 34 is formed integrally with side plates 33 extending upright from the proximal portion of the base plate portion 31 in such a manner that the top plate portion 34 is disposed in opposed relation to the resilient contact piece 32. The circuit end portion 28 of the printed circuit board 22 is inserted between and connected to the resilient contact piece 32 and the top plate portion 34.

In the above conventional construction, however, when the connection terminal 30 is to be attached to the female connector housing 26, or when the printed circuit board 22 is to be inserted into the connection terminal 30, the top plate portion 34 of the connection terminal 30 interferes with the female connector housing 26 or the printed circuit board 22, and is liable to be bent or deformed about the side plates 33 serving as a fulcrum. In this case, there are encountered problems that the insertion of the printed circuit board 22 is difficult, and that the electrical contact is adversely affected.

SUMMARY OF THE INVENTION

With the above problems in view, it is an object of this invention to provide a connector for a printed circuit board which prevents the deformation of a top plate portion of each connection terminal, thereby achieving a positive connection of a printed circuit board.

In order to attain the above-noted and other objects, the present invention provides a connector for a printed circuit board wherein the printed circuit board is adapted to be held between a resilient contact piece of each connection terminal, received in a terminal receiving chamber of a connector housing for an electrical connection, and a top plate portion of said connection terminal disposed in opposed relation to said resilient contact piece, and a guide projection to which said top plate portion of said connection terminal is adapted to be fitted is formed on an end wall of said terminal receiving chamber of said connector housing.

The guide projection of the connector housing fits in the top plate portion to hold the top plate portion against movement, and therefore the top plate portion will not interfere with the printed circuit board. Even if the top plate portion is deformed, this bending is corrected when the top plate portion is to be fitted on the guide projection. If the deformation is large, the top plate portion abuts against the guide projection, so that the attachment of the connection terminal is prevented.

DETAILED DESCRIPTION OF THE PREFERRED EMBODIMENTS

Figure 1:
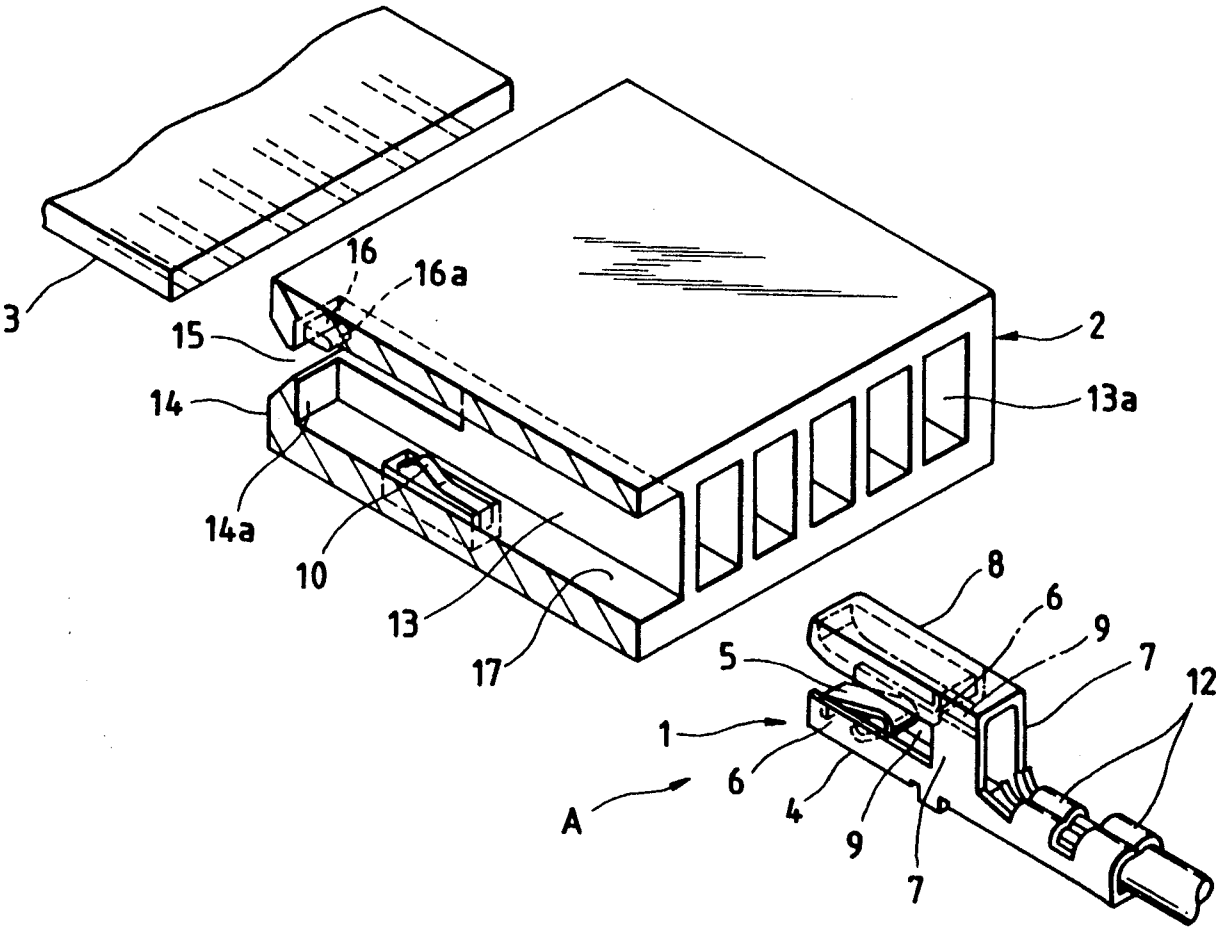
FIG. 1 is an exploded perspective view of one embodiment of a printed circuit board connector of the present invention.
Figure 2:
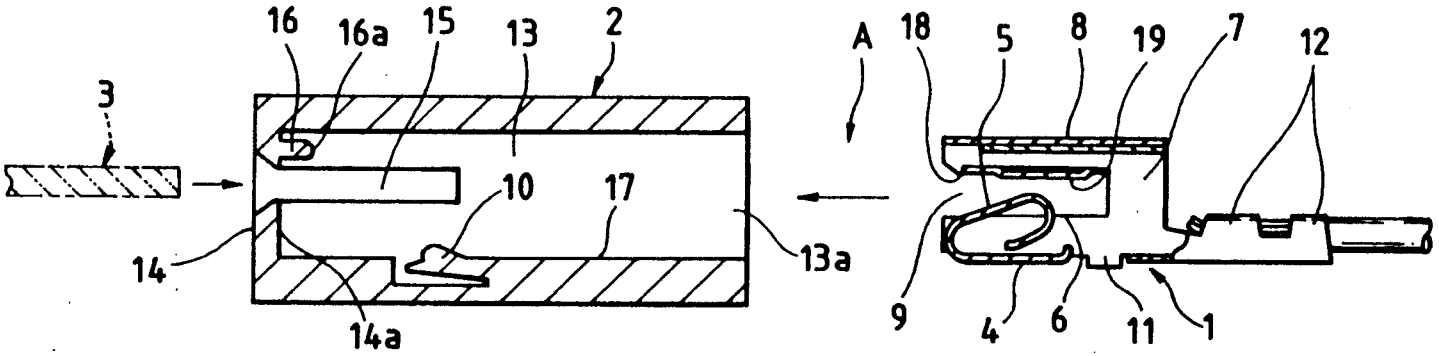
FIG. 2 is a vertical cross-sectional view thereof.

FIG. 1 is an exploded perspective view of one embodiment A of a printed circuit board connector of the present invention. FIG. 2 is a vertical cross-sectional view thereof.

In the drawings, reference numeral 1 denotes a connection terminal, reference numeral 2 a connector housing for receiving the connection terminal 1, and reference numeral 3 a printed circuit board to be connected.

With respect to the connection terminal 1, a folded-back, resilient contact piece 5 is formed integrally on a front end of a base plate portion 4, and side plate portions 6 and 6, which are smaller in height than the resilient contact piece 5, extend upright from the opposite sides of the base plate portion 4, respectively. Upstanding plate portions 7 and 7 extend from the rear portions of the side plate portions 6 and 6, respectively, and a top plate portion 8 of a rectangular tubular cross-section is formed integrally on the upper ends of the upstanding plate portions 7 and 7 in opposed relation to the resilient contact piece 5. An insertion slit 9 for receiving the printed circuit board 3 is formed between each of the side plate portions 6 and 6 and the top plate portion 8. A lower wall 18 of the rectangular tubular top plate portion 8 is bulged toward the resilient contact piece 5 to provide an electrical contact portion 19. An engagement hole 11 for a flexible retaining arm 10 (later described) of the connector housing 2 is formed in the base plate portion 4 intermediate the opposite ends thereof. An electrical connection portion 12 is provided at the rear end of the base plate portion 4.

On the other hand, the connector housing 2 is made of a synthetic resin, and has a plurality of juxtaposed terminal receiving chambers 13 each having an open rear end 13a. Insertion slits 15 for receiving the printed circuit board 3 are formed in the connector housing, and extend from a housing front wall 14 to the intermediate points of the terminal receiving chambers 13. A guide projection 16 for the tubular top plate portion 8 of the connection terminal 1 is formed on an upper portion of a front end wall 14a of each terminal receiving chamber 13. The flexible retaining arm 10 for engaging the engagement hole 11 of the connection terminal 1 is formed on a bottom wall 17 of the terminal receiving chamber 13.

The connector housing 2 is characterized in that it has the guide projection 16 which can be inserted and fitted into the tubular top plate portion 8 of the connection terminal 1. The guide projection 16 has a semispherical distal end 16a, and therefore can be smoothly fitted in the tubular top plate portion 8. The distal end 16a may have a wedge-shape.

Figure 3:
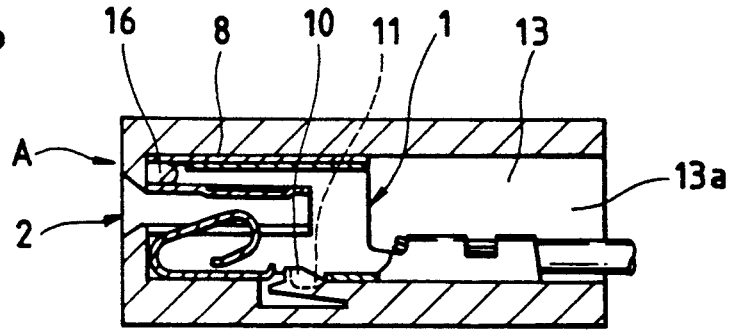
FIG. 3 is a vertical cross-sectional view showing a condition in which a connection terminal attached to a connector housing.

As shown in FIG. 3, the connection terminal 1 is inserted into the terminal receiving chamber 13 from the rear open end 13a, so that the guide projection 16 fits in the tubular top plate portion 8 of the connection terminal 1, thereby holding the top plate portion 8 against movement. Therefore, when the printed circuit board 3 is to be inserted, it will not interfere with the top plate portion 8, and the top plate portion 8 is prevented from being deformed. The flexible retaining arm 10 of the connector housing 2 is engaged in the engagement hole 11 of the connection terminal 1, thereby preventing a rearward withdrawal of the connection terminal 1.

Figure 4:
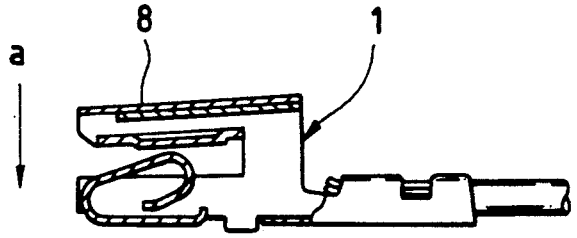
FIG. 4 is a vertical cross-sectional view of the connection terminal with its top plate portion deformed.
Figure 5:
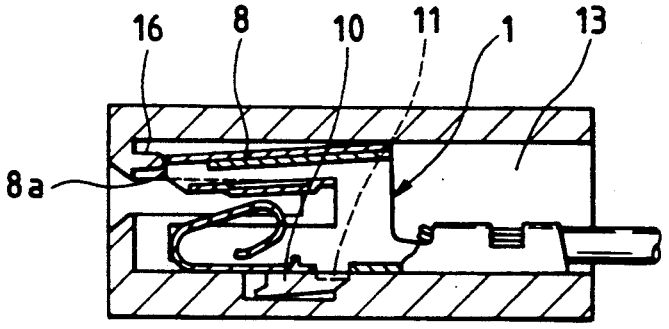
FIG. 5 is a vertical cross-sectional view showing a condition in which the deformed connector terminal is inserted in the connector housing.
Figure 6:
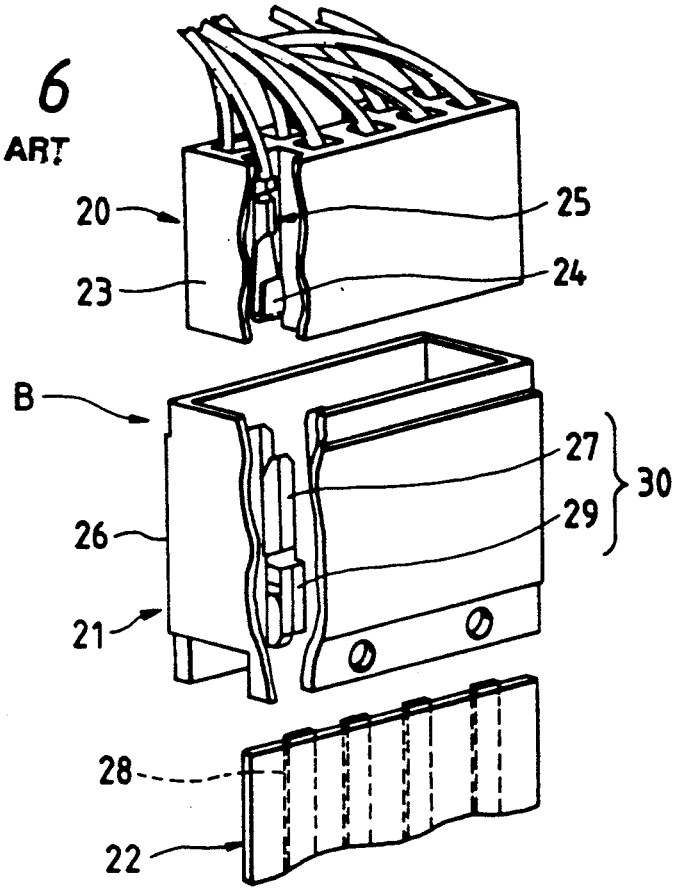
FIG. 6 PRIOR ART
FIG. 6 is an exploded perspective view of a conventional connector for a printed circuit board.
Figure 7:
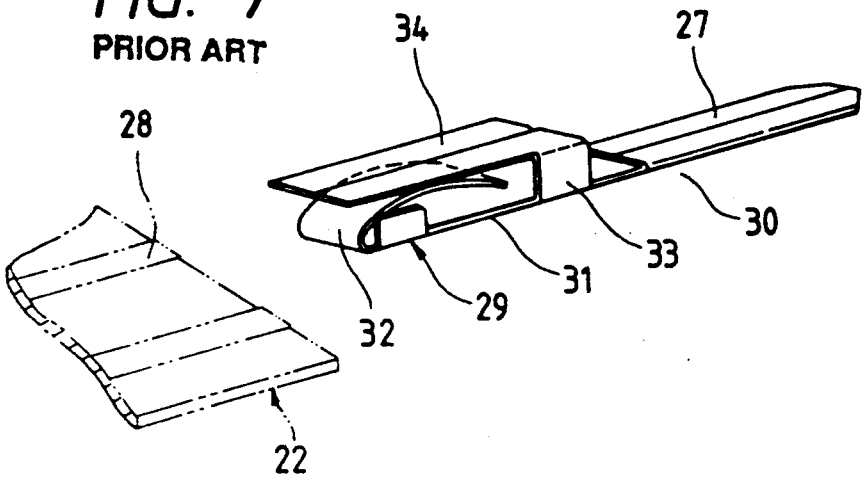
FIG. 7 PRIOR ART
FIG. 7 is a perspective view showing a conventional connection terminal.

As shown in FIG. 4, even if the top plate portion 8 has been slightly deformed or bent in a direction a, this bending can be corrected when the top plate portion fits on the guide projection 16. If the top plate portion 8 has been greatly deformed, a distal end 8a of the top plate portion 8 abuts against the guide projection 16, and the flexible retaining arm 10 will not be engaged in the engagement hole 11 as shown in FIG. 5, and therefore the connection terminal 1 is not retained within the terminal receiving chamber 13. Therefore, the operator can immediately find this abnormal condition safely.

As described above, in the present invention, the guide projection of the connector housing fits in the rectangular tubular top plate portion of the connection terminal to thereby support the top plate portion against movement, and therefore when the printed circuit board is to be inserted, it will not interfere with the connection terminal, thereby preventing the connection terminal from being deformed. Even if the top plate portion has been deformed, the bending is rectified when it fits on the guide projection. Therefore, the connection of the printed circuit board can be made smoothly and positively. Moreover, if the deformation of the top plate portion is large, the top plate portion abuts against the guide projection, so that the attachment of the connection terminal is prevented. This prevents the distribution of defective products.

What is claimed is:

1. A connector for a printed circuit board, comprising:

a connector housing having at least one terminal receiving chamber;

a connection terminal received in each said terminal receiving chamber, including a resilient contact piece and a top plate portion disposed in opposed relation to said resilient contact piece for holding said printed circuit board between said resilient contact piece and said top plate portion and eclectrically connecting a printed circuit on said board to said resilient contact piece; and a guide projection formed on an end wall of each said terminal receiving chamber and projecting into said chamber, said top plate portion being fitted onto said guide projection.

2. The connector according to claim 1, wherein said connection terminal is a single integral member including said resilient contact piece and said top plate portion.

3. The connector according to claim 1, further comprising a flexible lock arm forward on a bottom wall of each said terminal receiving chamber for retaining said connection terminal in each said terminal receiving chamber when said top plate portion is fitted onto said guide projection.

4. A connector for a printed circuit board, comprising:

a connector housing having at least one terminal receiving chamber;

a connection terminal received in each said terminal receiving chamber, including a resilient contact piece and a top plate portion disposed in opposed relation to said resilient contact piece for holding said printed circuit board between said resilient contact piece and said top plate portion and electrically connecting a printed circuit on said board to said resilient contact piece; and a guide projecting formed on an end wall of each said terminal receiving chamber, said top plate portion being fitted onto said guide projection, wherein said top plate portion is tubular and rectangular in cross-section.

5. A connector for a printed circuit board, comprising:

a connector housing having at least one terminal receiving chamber;

a connection terminal received in each said terminal receiving chamber, including a resilient contact piece and a top plate portion disposed in opposed relation to said resilient contact piece for holding said printed circuit board between said resilient contact piece and said top plate portion and eclectrically connecting a printed circuit on said board to said resilient contact piece; and a guide projection formed on an end wall of each said terminal receiving chamber, said top plate portion being fitted onto said guide projection, wherein said guide projection has a semispherical distal end.

6. A connector for a printed circuit board, comprising:

a connector housing having at least one terminal receiving chamber and insertion slits formed on one end portion thereof;

a connection terminal received in each said terminal receiving chamber, including a resilient contact piece and a top plate portion disposed in opposed relation to said resilient contact piece; and first engaging means provided on said connector housing and projecting into said at least one chamber for engaging and correctly positioning said top plate relative to said insertion slits, wherein said printed circuit board inserted through said insertion slits is held between said resilient contact piece and said top plate portion positioned by said first means for an electrical connection.

7. The connector according to claim 6, further comprising: second means for retaining said connection terminal in each said terminal receiving chamber when said top plate is correctly positioned relative to said insertion slits.

8. A connector for a printed circuit board, comprising:

a connector housing having at least one terminal receiving chamber and insertion slits formed on one end portion thereof;

a connection terminal received in each said terminal receiving chamber, including a resilient contact piece and a top plate portion disposed in opposed relation to said resilient contact piece; and first means provided on said connector housing for correctly positioning said top plate relative to said insertion slits and for preventing complete insertion of said connection terminal into said terminal receiving chamber when said top plate portion is deformed more than a predetermined amount towards said resilient contact piece, wherein said printed circuit board inserted through said insertion slits is held between said resilient contact piece and said top plate portion positioned by said first means for electrical connection when said top plate portion is deformed less than said predetermined amount.

* * * * *